US011561039B2

(12) United States Patent
Caglin et al.

(10) Patent No.: US 11,561,039 B2
(45) Date of Patent: Jan. 24, 2023

(54) SEALING ASSEMBLY HAVING IMPROVED HEAT INSULATION PROPERTIES AND COOLING DEVICE HAVING THE SEALING ASSEMBLY

(71) Applicant: BSH Hausgeraete GmbH, Munich (DE)

(72) Inventors: Muharrem Uemit Caglin, Istanbul (TR); Tezcan Cetin, Tekirdag (TR); Ibrahim Tugrul Soenmez, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 17/356,770

(22) Filed: Jun. 24, 2021

(65) Prior Publication Data

US 2021/0404736 A1 Dec. 30, 2021

(30) Foreign Application Priority Data

Jun. 26, 2020 (TR) ..... 2020/10038

(51) Int. Cl.
*F25D 23/08* (2006.01)
*F25D 23/02* (2006.01)

(52) U.S. Cl.
CPC ..... *F25D 23/087* (2013.01); *F25D 23/02* (2013.01)

(58) Field of Classification Search
CPC ..... F25D 23/087; F25D 23/082
See application file for complete search history.

(56) References Cited

U.S. PATENT DOCUMENTS

| | | | | |
|---|---|---|---|---|
| 8,240,091 | B2 | 8/2012 | Cittadini et al. | |
| 11,306,967 | B2 * | 4/2022 | Rotter | F16J 15/3252 |
| 2003/0222553 | A1 * | 12/2003 | Lee | F25D 23/087 312/405 |
| 2006/0188690 | A1 * | 8/2006 | Jun | F25D 23/087 428/99 |
| 2018/0299189 | A1 * | 10/2018 | Johnson | F16J 15/104 |
| 2018/0372396 | A1 * | 12/2018 | Willert | E06B 7/2309 |
| 2019/0093941 | A1 * | 3/2019 | Guo | F25D 23/087 |
| 2019/0128591 | A1 * | 5/2019 | Visin | F25D 23/02 |
| 2020/0003481 | A1 * | 1/2020 | Okazaki | F25D 21/04 |
| 2020/0011590 | A1 * | 1/2020 | Johnson | E06B 7/2309 |

FOREIGN PATENT DOCUMENTS

EP 1869379 B1 1/2010

* cited by examiner

*Primary Examiner* — Daniel J Rohrhoff
(74) *Attorney, Agent, or Firm* — Laurence A. Greenberg; Werner H. Stemer; Ralph E. Locher

(57) ABSTRACT

A sealing assembly seals an area between a door and a cabinet of a cooling device. The sealing assembly contains a magnet chamber which defines a receiving cavity for accommodating a magnetic element, a first air chamber provided at one side of the sealing assembly, an attachment portion for attaching the sealing assembly to the door of the cooling device, and an inner air chamber provided between the magnet chamber and the attachment portion. The sealing assembly contains a second air chamber provided between the magnet chamber and the first air chamber. A first separator wall is arranged in the second air chamber to partition the second air chamber into at least two upper sections and/or a second separator wall is arranged in the inner air chamber to partition the inner air chamber into at least two intermediate air sections.

15 Claims, 7 Drawing Sheets

SEALING ASSEMBLY HAVING IMPROVED HEAT INSULATION PROPERTIES AND COOLING DEVICE HAVING THE SEALING ASSEMBLY

CROSS-REFERENCE TO RELATED APPLICATION

This application claims the priority, under 35 U.S.C. § 119, of Turkish Patent Application TR 2020/10038, filed Jun. 26, 2020; the prior application is herewith incorporated by reference in its entirety.

BACKGROUND OF THE INVENTION

Field of the Invention

The present invention relates to a sealing assembly for a cooling device, in particular for a refrigerator, to reduce heat loss during the refrigeration cycle in the cooling device.

Cooling devices (i.e., refrigerators) are needed for keeping the food fresh for a predetermined period by reducing the temperature of a refrigerating compartment and a freezing compartment.

Sealing assemblies (i.e., gaskets) in such cooling devices are used as a mechanical seal that fills the space between two or more mating surfaces, generally to prevent leakage and heat loss on an area between a door and a cabinet of the cooling device. When the sealing assembly is cooled down by the cold air of the refrigerating compartment, water droplets may be formed on an outer surface of the sealing assembly. Despite the use of heaters in cooling devices, condensation on an outer surface of the sealing assembly may still be occurring.

A prior art publication in the technical field of the present invention may be referred to as European patent EP1869379 (B1), corresponding to U.S. Pat. No. 8,240,091, among others, the document disclosing a gasket for refrigerator cabinets of the type including a soft bellows-type portion for sealing the area between a cabinet and a door, as well as a base portion able to fit the outer door and/or inner door of the refrigerator cabinet, wherein the shell is defined by the outer door and inner door filled with thermal insulation material.

There is a need for an improved sealing assembly with more efficient design by eliminating water droplet formation at the same time.

BRIEF SUMMARY OF THE INVENTION

An object of the present invention is to provide a sealing assembly for increasing the thermal insulation of the sealing assembly and preventing sweating that may occur on an outer surface of the sealing assembly.

The present invention proposes a sealing assembly for sealing an area between a door and a cabinet of a cooling device. The sealing assembly includes a magnet chamber which defines a receiving cavity for accommodating a magnetic element, a first air chamber provided at one side of the sealing assembly, an attachment portion for attaching the sealing assembly to the door of the cooling device, and an inner air chamber provided between the magnet chamber and the attachment portion. The sealing assembly further has a second air chamber provided between the magnet chamber and the first air chamber; and a first separator wall arranged in the second air chamber to partition the second air chamber into at least two upper sections and/or a second separator wall arranged in the inner air chamber to partition the inner air chamber into at least two intermediate air sections. This arrangement helps to reduce the thermal losses in the door and prevents sweating on the sealing assembly by improving the energy consumption level and humidity level class of the cooling device.

In a possible embodiment, the sealing assembly contains a contact wall forming an upper surface of the sealing assembly to contact the cabinet. Microscopic gaps may exist between the door and the opening, so that cold air within the storage room leaks out of the refrigerator. The flat shaped contact wall helps to eliminate these gaps.

In a possible embodiment, the first separator wall extends in a vertical direction within the second air chamber with respect to the contact wall. With this arrangement, one more air chamber is created next to the magnet chamber so that the thermal losses in the door is reduced.

In a possible embodiment, the two upper sections have a rectangular cross-section. Thus, optimum sealing performance is obtained.

In a possible embodiment, the first separator wall extends in a horizontal direction within the second air chamber with respect to the contact wall. Thus, the adverse effect of the heat coming from a heater thereof is effectively reduced.

In a possible embodiment, the first separator wall extends in a cross direction within the second air chamber with respect to the contact wall. Providing one more air chamber next to the magnet chamber helps to prevent the cold air from leaking together with the sealing assembly.

In a possible embodiment, the two upper sections are identical. Thus, the condensation problem thereof is effectively reduced; the optimum sealing performance is obtained.

In a possible embodiment, two upper sections have a triangular cross-section. Thus, optimum heat losses through magnet are obtained. The user's convenience is enhanced by preventing water drop formation.

In a possible embodiment, the second separator wall has a V-shaped cross-section. Providing one more air chamber next to the magnet chamber helps to prevent the cold air from leaking together with the sealing assembly.

In a possible embodiment, the second air chamber has a polygonal cross-section, preferably a rectangular or a square cross-section.

In a possible embodiment, a cross-section of the second air chamber is smaller than a cross-section of the first air chamber. This created zone helps to increase the performance of the sealing assembly efficiently and does not need any complex modification.

In a possible embodiment, the magnet chamber, the first air chamber and the second air chamber are aligned on the same horizontal axis. This arrangement increases the thermal efficiency and helps to maintain the components strictly together.

In a possible embodiment, numbers of the additional air chambers of the second air chamber and the inner air chamber can be increased.

In a possible embodiment, the sealing assembly is made of soft material, such as a plasticized PVC, a rubber or similar.

The present invention also proposes a cooling device, particularly a refrigerator, having the sealing assembly.

Other features which are considered as characteristic for the invention are set forth in the appended claims.

Although the invention is illustrated and described herein as embodied in a sealing assembly having improved heat insulation properties, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
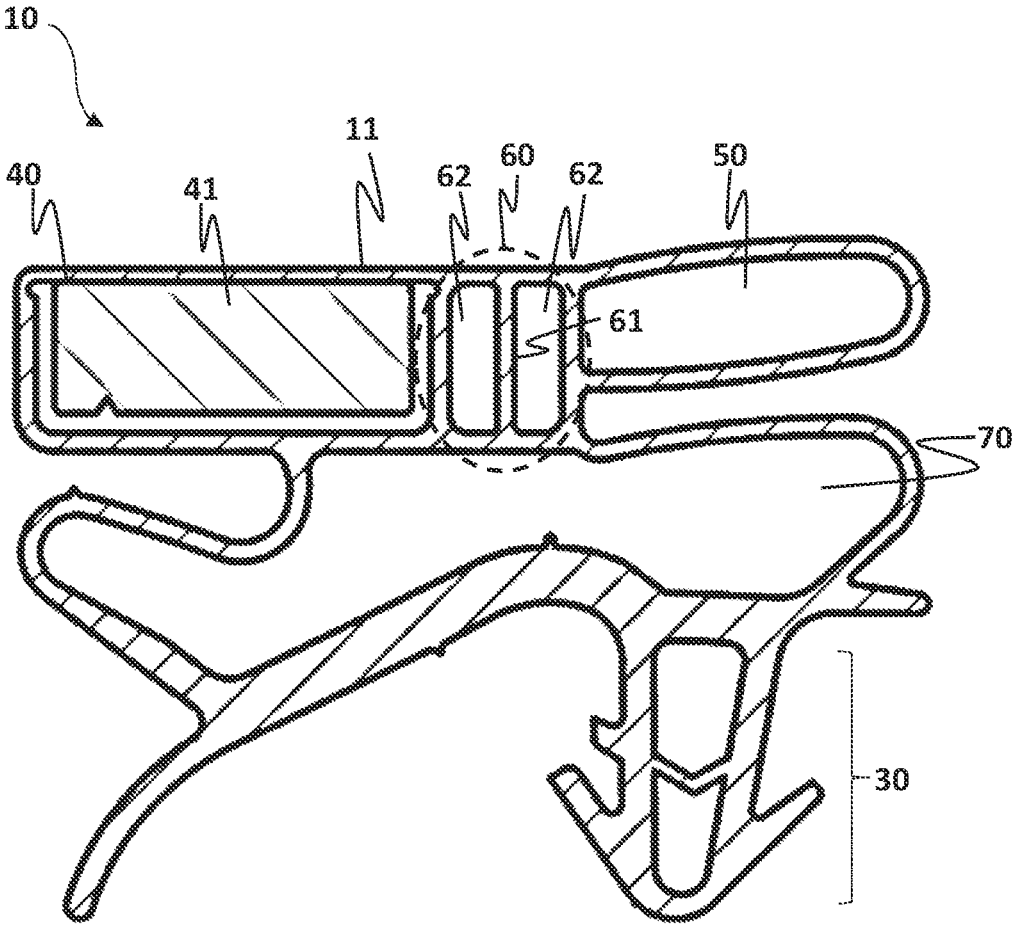
FIG. 1 is a diagrammatic, cross-sectional view of a sealing assembly according to a first embodiment of the present invention.
Figure 6:
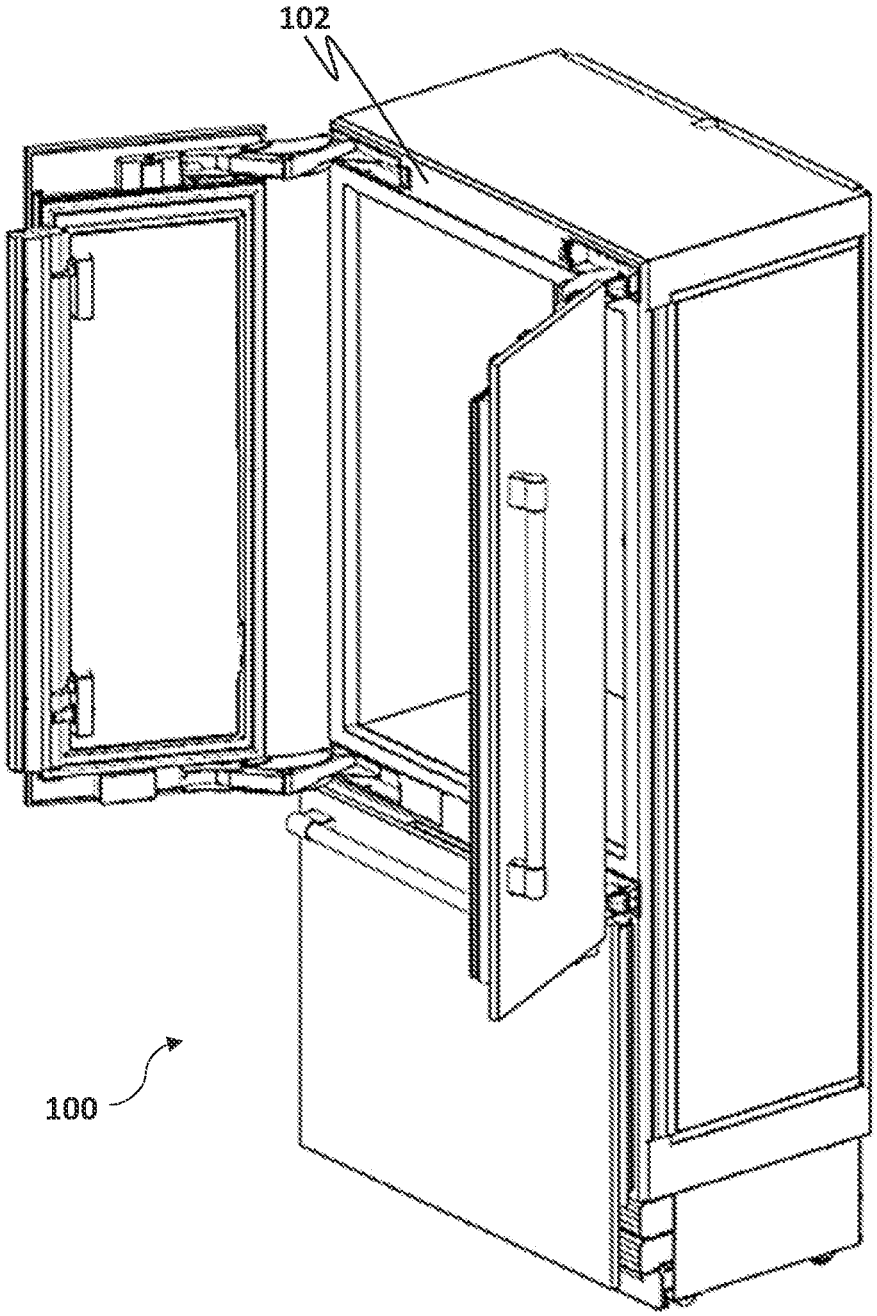
FIG. 6 is another perspective view of the cooling device shown in FIG. 5, according to the present invention.
Figure 7:
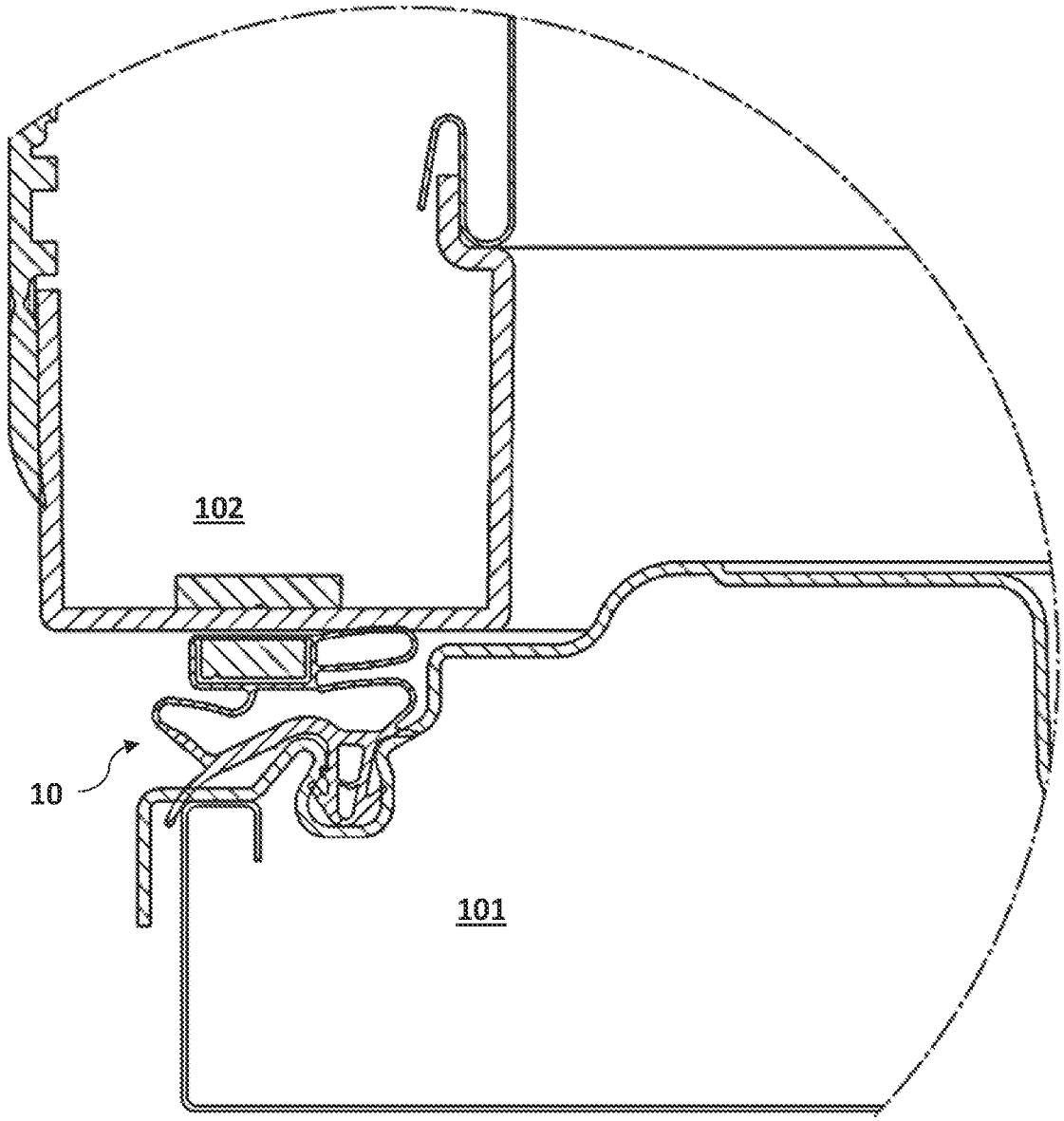
FIG. 7 (PRIOR ART)
FIG. 7 is a cross-sectional view of the sealing assembly attached to the cooling device according to the prior art.

Referring now to the figures of the drawings in detail and first, particularly to FIGS. 1 and 6 thereof, there is shown a sealing assembly 10 for sealing an area between a door 101 and a cabinet 102 of a cooling device 100. The sealing assembly contains a magnet chamber 40 which defines a receiving cavity for accommodating a magnetic element 41, a first air chamber 50 provided at one side of the sealing assembly 10, an attachment portion 30 for attaching the sealing assembly 10 to the door 101 of the cooling device 100, and an inner air chamber 70 provided between the magnet chamber 40 and the attachment portion 30. The sealing assembly 10 further contains a second air chamber 60 provided between the magnet chamber 40 and the first air chamber 50; and a first separator wall 61 arranged in the second air chamber 60 to partition the second air chamber 60 into at least two upper sections 62 and/or a second separator wall 71 arranged in the inner air chamber 70 to partition the inner air chamber 70 into at least two intermediate air sections 72, see FIG. 4. The refrigerating compartment of the cooling device can be called a cold region, and outside of the cooling device can be called a warm region. The first separator wall 61 and the second separator wall 71 create one more additional air zone between the cold region and the warm region. The sealing assembly 10 has a contact wall 11, forming an upper surface of the sealing assembly 10 to contact the cabinet 102.

According to the present invention, four different embodiments of the sealing assembly 10 are shown in FIG. 1 to FIG. 4, respectively. According to the first embodiment of the sealing assembly shown in FIG. 1, the first separator wall 61 extends in a vertical direction within the second air chamber 60 with respect to the contact wall 11. According to the first embodiment of the invention, the second air chamber 60 is divided into two sections by the first separator wall 61 to prevent sweating on the sealing assembly 10 and to improve the energy consumption level of the cooling device. As shown in FIG. 1, a vertically-directed first separator wall 61 creates the two identical upper sections 62. Accordingly, the two upper sections 62 have a rectangular cross-section. Moreover, the first separator wall 61 is monolithic and extends between a top wall of the second air chamber 60 facing outside and a bottom wall of the second air chamber 60 facing the inner air chamber 70.

Figure 2:
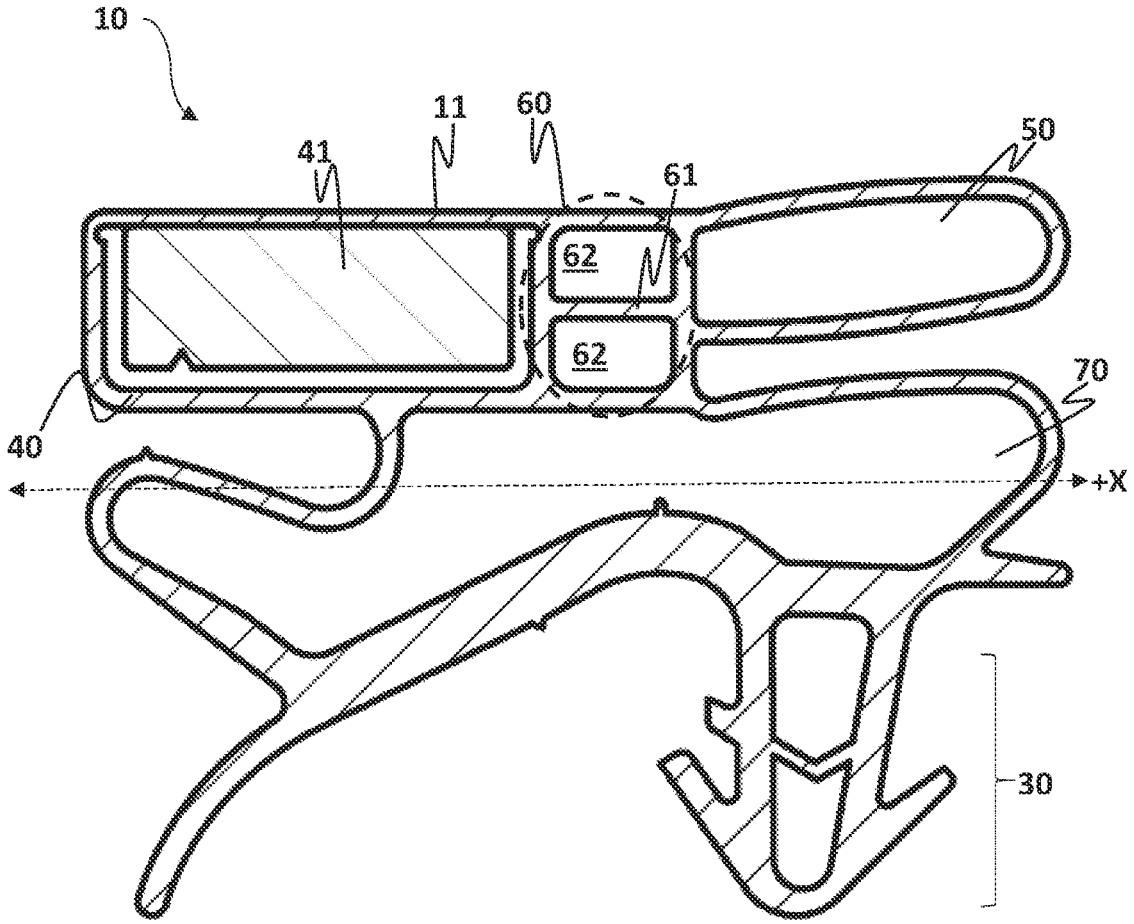
FIG. 2 is a cross-sectional view of the sealing assembly according to a second embodiment of the present invention.

According to the second embodiment of the sealing assembly 10 shown in FIG. 2, the first separator wall 61 extends in a horizontal direction +X within the second air chamber 60 with respect to the contact wall 11. Similarly, these created the two upper sections 62 are substantially identical and have a rectangular cross-section. As shown in FIG. 2, a horizontally-directed first separator wall 61 creates the two identical upper sections 62. Accordingly, the two upper sections 62 have a rectangular cross-section. Moreover, the first separator wall 61 is monolithic and extends between the sidewalls of the second air chamber 60.

Figure 3:
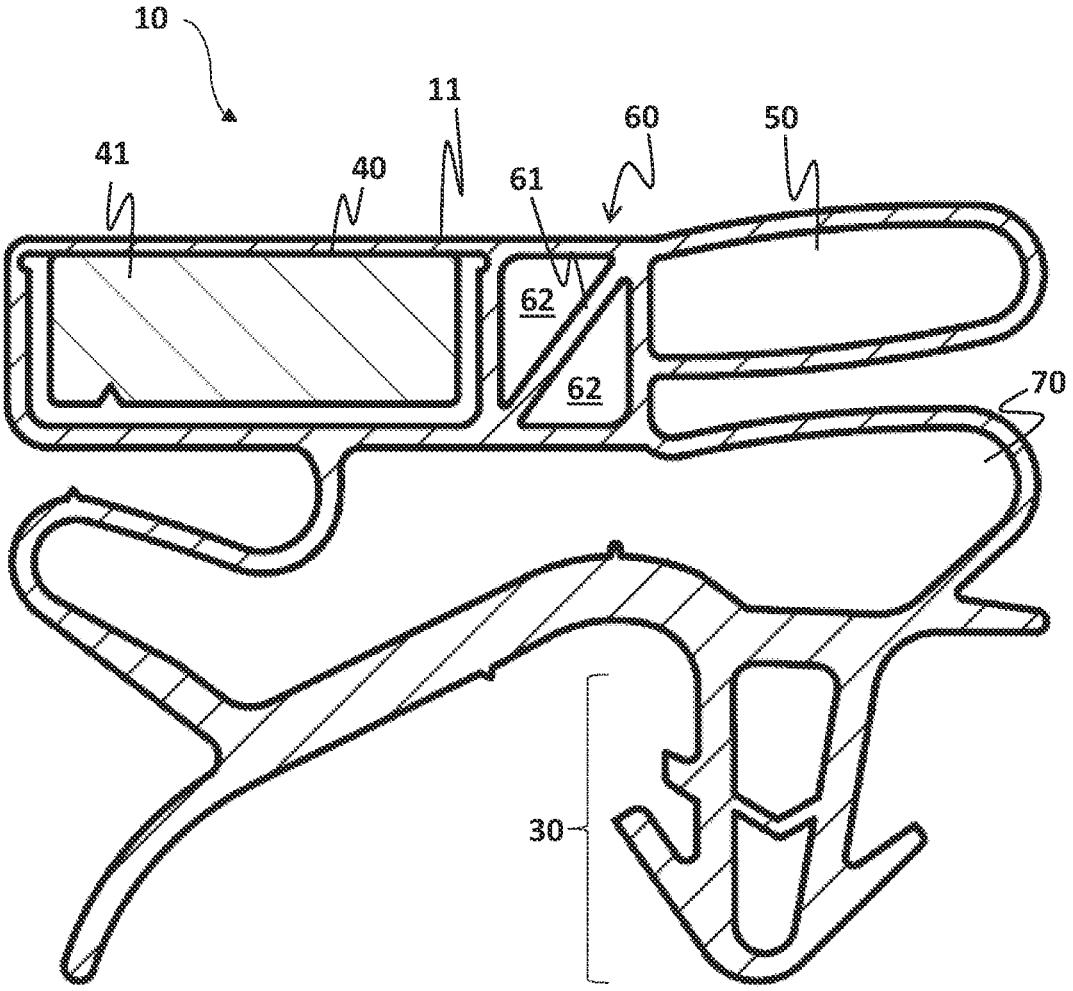
FIG. 3 is a cross-sectional view of the sealing assembly according to a third embodiment of the present invention.

Similarly, according to the third embodiment of the sealing assembly 10 shown in FIG. 3, the first separator wall 61 extends in a cross direction within the second air chamber 60 with respect to the contact wall 11. The two upper sections 62 are identical and have a triangular cross-section. The cross-directed first separator wall 61 is monolithic and extends from an edge next to the first air chamber 50 to another edge next to the magnet chamber 40.

Figure 4:
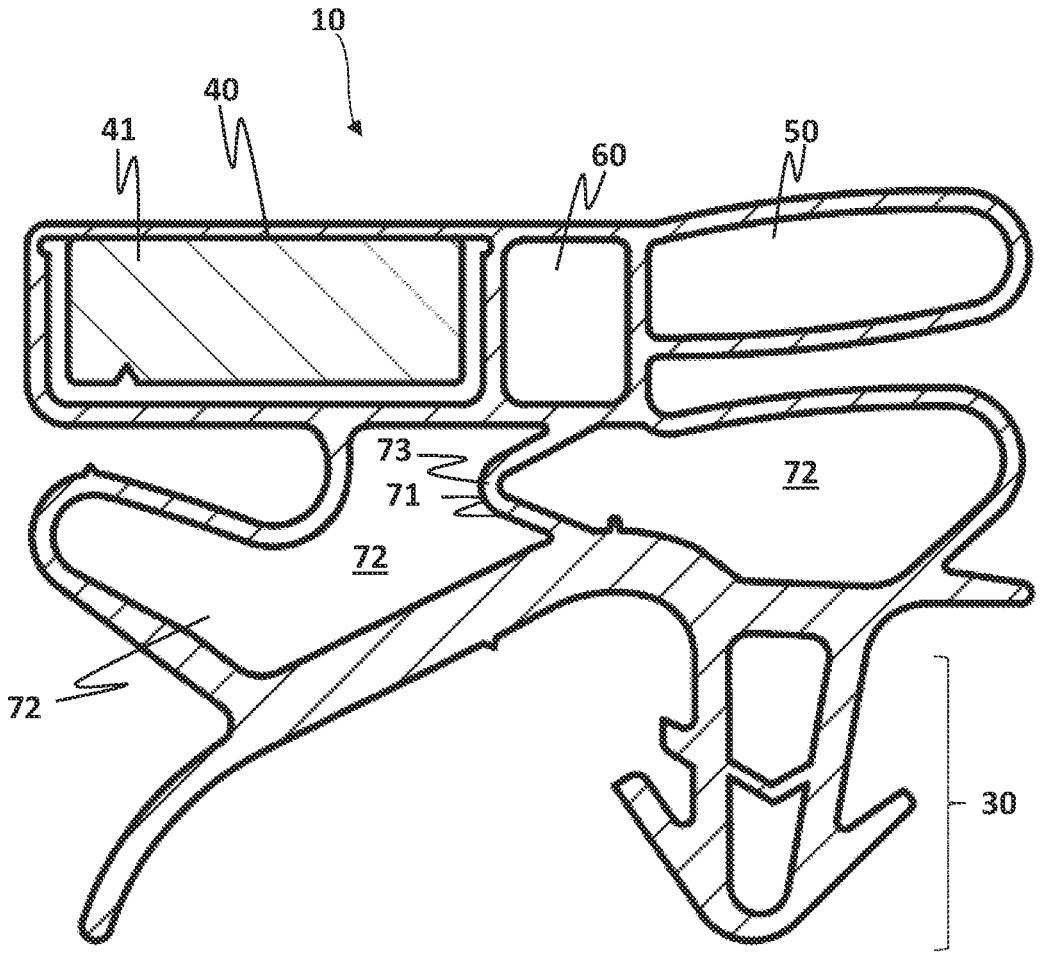
FIG. 4 is a cross-sectional view of the sealing assembly according to a fourth embodiment of the present invention.

According to the fourth embodiment of the sealing assembly 10 shown in FIG. 4, the second separator wall 71 has a substantially V-shaped cross-section. This arrangement can be used with other embodiments of the sealing assembly 10 or alone, thereby preventing (or at least significantly reducing) dewing around the sealing assembly 10. The second separator wall 71 is monolithic and extends from the bottom wall of the second air chamber 60 to the bottom wall of the inner air chamber 70 facing the attachment portion 30. The second separator wall 71 creates two intermediate air sections 72 having different forms each other with elastic outer side walls. Especially, a tip portion 73 of the second separator wall 71 bends towards the magnetic chamber 40. Using more air chambers simultaneously helps to eliminate the negative cooling effect on the functionality of the sealing assembly 10.

The second air chamber 60 has a polygonal cross-section, preferably a rectangular or a square cross-section. Moreover, a cross-section of the second air chamber 60 is smaller than a cross-section of the first air chamber 50.

Referring to the FIGS. 1 to 4, the magnet chamber 40, the first air chamber 50, and the second air chamber 60 are substantially aligned on the same horizontal axis +X. The magnetic element 41 is encased within the magnet chamber 40 wherein the magnetic element 41 is an elongated rectangle and is preferably a dual pole magnet having either north or south poles at each of its latitudinal ends.

Figure 5:
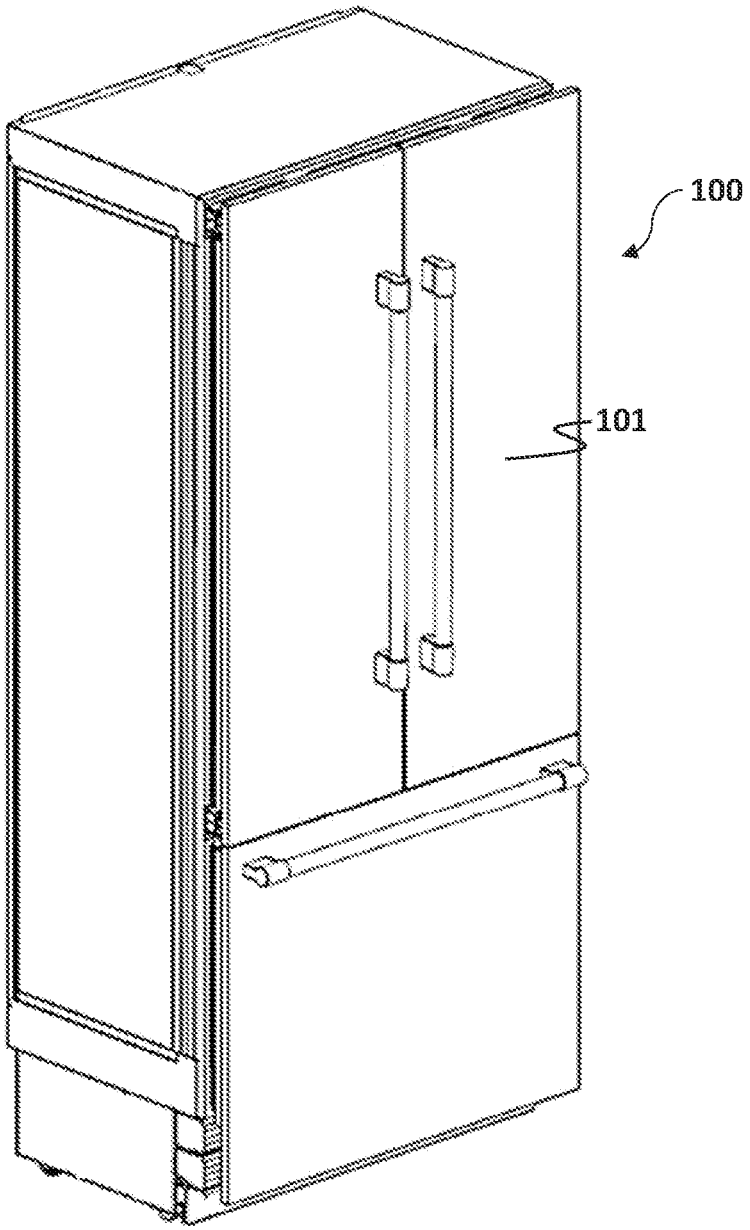
FIG. 5 is a perspective view of a cooling device in which the sealing assembly can be attached, according to the present invention.

Referring to FIGS. 5 and 6, the cooling device 100 can be a refrigerator, which comprises an insulated body. Door(s) 101 of the cooling device 100 can be secured by hinged attachment to an insulated body so that the door 101 will open away from the cabinet 102 while pivoting upon the hinged attachments. The sealing assembly 10 is arranged to surround the entire periphery of an interior surface of the door 101 and is formed of rubber or another suitable elastomeric material that defines a number of collapsible air spaces. The referred cooling device 100 can be at least one of a refrigerator, a freezer, a fridge-freezer combination device, and a wine cabinet.

The following is a summary list of reference numerals and the corresponding structure used in the above description of the invention:

10. Sealing assembly
11. Contact wall
30. Attachment portion
40. Magnet chamber
41. Magnetic element
50. First air chamber
60. Second air chamber
61. First separator wall
62. Upper section
70. Inner air chamber
71. Second separator wall
72. Intermediate air section
73. Tip portion
100. Cooling device
101. Door
102. Cabinet
+X Horizontal axis

The invention claimed is:

1. A sealing assembly for sealing an area between a door and a cabinet of a cooling device, the sealing assembly comprising:
- a magnetic element;
- a magnet chamber defining a receiving cavity for accommodating said magnetic element;
- a first air chamber disposed at one side of the sealing assembly;
- an attachment portion for attaching the sealing assembly to the door of the cooling device;
- an inner air chamber disposed between said magnet chamber and said attachment portion;
- a second air chamber completely disposed between said magnet chamber and said first air chamber;
- a first separator wall disposed in said second air chamber to partition said second air chamber into at least two upper sections; and
- said magnet chamber, said first air chamber and said second air chamber are aligned on a same horizontal axis.

2. The sealing assembly according to claim 1, further comprising a contact wall forming an upper surface of the sealing assembly to contact the cabinet.

3. The sealing assembly according to claim 2, wherein said first separator wall extends in a vertical direction within said second air chamber with respect to said contact wall.

4. The sealing assembly according to claim 3, wherein said at least two upper sections are identical.

5. The sealing assembly according to claim 3, wherein said at least two upper sections have a rectangular cross-section.

6. The sealing assembly according to claim 2, wherein said first separator wall extends in a horizontal direction within said second air chamber with respect to said contact wall.

7. The sealing assembly according to claim 6, wherein said at least two upper sections are identical.

8. The sealing assembly according to claim 6, wherein said at least two upper sections each have a rectangular cross-section.

9. The sealing assembly according to claim 2, wherein said first separator wall extends in a cross direction within said second air chamber with respect to said contact wall.

10. The sealing assembly according to claim 9, wherein said at least two upper sections are identical.

11. The sealing assembly according to claim 9, wherein said at least two upper sections each have a triangular cross-section.

12. The sealing assembly according to claim 1, wherein said second separator wall has a V-shaped cross-section.

13. The sealing assembly according to claim 1, wherein said second air chamber has a cross-section being smaller than a cross-section of said first air chamber.

14. A cooling device, comprising:
- a cabinet;
- a door closing said cabinet;
- a sealing assembly for sealing an area between said door and said cabinet of the cooling device, said sealing assembly containing:
  - a magnetic element;
  - a magnet chamber defining a receiving cavity for accommodating said magnetic element;
  - a first air chamber disposed at one side of said sealing assembly;
  - an attachment portion for attaching said sealing assembly to said door of the cooling device;
  - an inner air chamber disposed between said magnet chamber and said attachment portion;
  - a second air chamber completely disposed between said magnet chamber and said first air chamber;
  - a first separator wall disposed in said second air chamber to partition said second air chamber into at least two upper sections; and
  - said magnet chamber, said first air chamber and said second air chamber are aligned on a same horizontal axis.

15. The cooling device according to claim 14, wherein the cooling device is a refrigerator.

* * * * *